US005251359A

United States Patent [19]

Finkl

[11] Patent Number: 5,251,359

[45] Date of Patent: Oct. 12, 1993

[54] HEAVY DUTY OFFSET TUBE HINGE

[76] Inventor: Anthony W. Finkl, 445 E. Royal Flamingo Dr., Sarasota, Fla. 34236

[21] Appl. No.: 902,126

[22] Filed: Jun. 22, 1992

[51] Int. Cl.[5] ..... E05D 11/00

[52] U.S. Cl. ..... 16/349; 16/348; 16/352; 16/357; 403/102

[58] Field of Search ..... 403/65, 100, 102, 319; 285/283; 16/348, 349, 352, 357, 363

[56] References Cited

U.S. PATENT DOCUMENTS 1,703,969 3/1929 Syvrud ..... 16/357

3,295,699 1/1967 Bauernschub, Jr. ..... 16/352

4,641,395 2/1987 Banks ..... 16/348

*Primary Examiner*—W. Donald Bray

*Attorney, Agent, or Firm*—Baker & McKenzie

[57] ABSTRACT

A high strength offset tube hinge is provided for coupling tubing or rods. The hinge has a limited range and prevents overextension with a built-in stop feature that prevents any angles over the limited range. The application for the hinge lies in convertible tops for automobiles and boats as well as awnings or similar applications where it is desirable to have two coupled tubes or rods with limited pivoting range in a single plane.

16 Claims, 1 Drawing Sheet

HEAVY DUTY OFFSET TUBE HINGE

This invention relates generally to high strength hinges for tubes or rods that allows two coupled tubes or rods to be pivoted through a substantial range. More particularly, the invention relates to an improved heavy duty tube hinge that allows two coupled tubes to be pivoted from 0° or the folded back or open position to 180° or the closed or in-line position. The hinge also includes a stop feature that prevents angles greater than 180° or "negative angles". Further, the improved heavy duty hinge provides clearance between the two tubes or rods when the hinge is in the 0° or folded back or open position.

BACKGROUND OF THE INVENTION

The construction of convertible tops for automobiles and boats requires coupled tubes or rods to pivot about an axis as the top is open and shut. The desired range of motion for two coupled tubes is normally 180°. In most convertible top designs, the top or hinge would be damaged if the tubes were allowed to pivot beyond 180° or achieve a negative angle position. For example, if the upper tubes of a convertible top were allowed to bend beyond 180°, the tarp cover of the top could be torn or damaged. In boat applications, it is often desirable to have a 180° "stop" for a boat top in order to provide additional rigidity to protect against wind damage. Similar "stops" are desirable in awning designs.

Thus, there is a need for a coupling hinge that will couple two tubes or rods in an end-to-end fashion and allow the tubes or rods to pivot from a 0° or folded orientation to a 180° or fully closed position. Further, there is a need for a coupling hinge of this type to have a built-in stop at the 180° or the fully closed position thereby preventing any undue damage to the convertible top, collapsible top or awning.

The traditional coupling hinge for joining two rods or tubes in an end-to-end relationship is commonly known as a clevis. A clevis normally consists of a U-shaped member or yoke that pivotally engages a rod end or a top cap. The rod end is pivotally connected to the U-shaped member with a clevis pin or a dowel. A tube or rod is connected to the outer ends of both the U-shaped member and the rod end. A clevis therefore provides a coupling connection for two tubes or rods.

In addition to the just described U-shaped member or yoke, a commercially available clevis may include a U-shaped member or female clevis that mounts onto a deck. Further, the U-shaped member or female clevis portion may be mounted on the side of a tube or rod or the end of a tube or rod.

However, these traditional clevis arrangements provide for rotation in both the positive or negative direction and only allows partial rotation of approximately 270° total swing as opposed to 180° in one direction for the offset tube hinge. In order to provide a 180°, single-direction hinge connection, an additional stop mechanism must be employed that is separate and apart from the standard clevis fitting. The present invention obviates the need for an additional and separate stop mechanism by providing a clevis fitting with a built-in stop at the 180° or closed position.

BRIEF DESCRIPTION OF THE INVENTION

The present invention makes a significant contribution to the metal fitting or coupling art by providing a clevis fitting with a built-in stop in the 180° or closed or in-line position. Further, the improved clevis is able to fold 180° back on itself to the 0° or open or folded back position without pinching or cutting the covering material by leaving sufficient clearance between the parallel tubes determined by the amount of the offset of the pivot pin. The improved clevis fitting provides an improved hinge mechanism for two tubes or rods. The improved hinge includes a clevis with a U-shaped inner end and an outer end that is attached to a tube or rod. The U-shaped inner end consists of two ear portions arranged in parallel fashion. The U-shaped inner end is further defined by an end wall disposed between the two parallel ear portions.

The rod end or the top cap of the prior art has been replaced by a spade member having an inner end for engaging the U-shaped inner end of the clevis and an outer end also for mateably engaging a tube or rod. The inner end of the spade includes an ear portion of similar shape to the ear portions of the U-shaped inner end of the clevis. Thus, when the spade is engaged by the clevis, with a transverse pivot pin, and the hinge is in the 180° or closed position, the two ear portions of the clevis and the single ear portion of the spade are in approximate matching registry.

The upper ends of each ear portion include a hole for accommodating the pivot pin or clevis pin. The pivot pin defines the axis about which the hinge pivots. The pivot axis is offset or disposed above the upper portions of the outer peripheries of the two tubes or rods that are attached to the clevis and spade members. Because the pivot axis is offset, one tube or rod may fold back on top of the other tube or rod without damaging the covering material.

The stop mechanism is provided by the lower end of the ear portion of the spade which abuts the lower end of the wall of the U-shaped clevis when the hinge is in the 180° or closed position. The lower end of the ear portion of the spade pivots away from the lower end of the wall of the clevis when the hinge is pivoted to a position of less than 180° or towards the open or collapsed position.

Thus, the hinge pivots about an axis defined by the pivot pin. The 0° or open position is the position where the tube (or rod) connected to the spade and the tube (or rod) connected to the clevis are overlying each other. If the hinge is employed in a boat cover, the cover is open when the tubes overlie each other. The 180° or closed position is defined as the position when the pivot angle about the pivot pin is 180° or fully closed. Again, if the hinge is employed in a boat cover, the cover is closed when the hinge is in the 180° or in-line position. In the closed position, the lower end of the ear of the spade positively abuts the lower end of the wall of the U-shaped inner end of the clevis. The two tubes or rods cannot close any further and are effectively stopped at the 180° angle or closed fixed position.

A side boss attachment may be affixed to an outer surface of one of the ear portions of the clevis. A tube or rod may be attached to the side boss or the side boss may be directly connected to a fixed structure to prevent displacement or rotation of the entire hinge.

The purpose of the side boss is to accommodate a transverse support bow for the covering top as in a convertible automotive top. The side boss for a support bow will either rotate or remain stationary dependent upon whether the U-shaped inner end or the spade member rotates. By rotating the entire hinge assembly 180° (front to back, back to front), one can select a rotating support bow or a stationary support bow depending on the installer's intention.

Further, it will be noted that adjustments to the shape of the spade and to the wall of the U-shaped inner end of the clevis will result in an closed position which is not 180° but either a larger or smaller angle as desired.

It is therefore an object of the present invention to provide a high strength, heavy duty offset pivot tube hinge.

Another object of the present invention to provide a tube hinge with a pivot range of 180° in a single direction.

Another object of the present invention to provide a tube hinge with a fully closed position of more or less than 180°.

A further object of the present invention to provide a tube hinge that will not permit negative angles or angles beyond the 180° closed position.

Yet another object of the present invention to provide a tube hinge that permits deflection in one direction only.

And, another object of the present invention to provide a tube hinge that may be rigidly locked in the closed or 180° position.

BRIEF DESCRIPTION OF THE DRAWINGS

This invention is illustrated more or less diagrammatically in the accompanying drawings wherein.

DETAILED DESCRIPTION OF THE INVENTION

Like referenced numerals will be used to refer to like or similar parts from Figure to Figure in the following description of the drawings.

The dramatic improvement contributed by this invention is best understood after consideration of how a traditional clevis works. A traditional clevis commonly employs a U-shaped member or yoke and a rod end or top cap that is accommodated between the fingers of the U-shaped member or yoke. A pivot pin extends through both fingers of the U-shaped member and through the rod end thereby providing a pivotal hinge connection. Tubes or rods are attached to the outer ends of the U-shaped member and the rod end. Therefore, two tubes or rods can be easily pivotally attached to each other.

The problem with the traditional clevis design is that it is not appropriate for all applications because the two tubes or rods that are pivotally attached to each other are free to pivot in both positive and negative directions up to approximately 270 ° but not permitting 180° rotation in a single direction. Many applications for the pivotal attachment of two tubes or rods call for a limited pivotal range of perhaps 0° to 180° and in one direction only, depending upon the specific application. The present invention satisfies this need.

Figure 1:
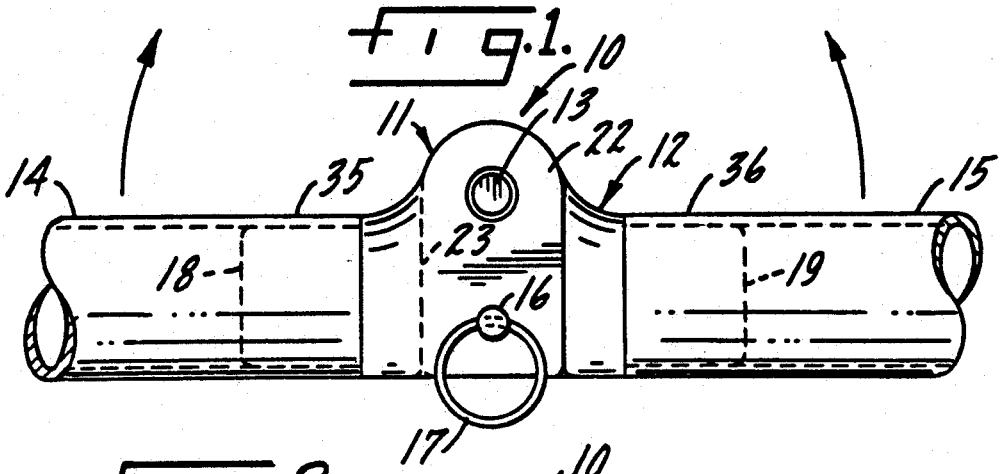
FIG. 1 is a front view of a tube hinge made in accordance with the present invention and illustrating the hinge in the 180° or closed position.

As seen in FIG. 1, the improved hinge 10 for tubing provided by the present invention includes a clevis 11, a spade 12 and a pivot pin 13. The hinge 10 provides a pivotal connection between the left extension member or tube 14 and the right extension member or tube 15. The tube 14 is mateably engaged over the outer end 18 of the clevis 11. Similarly, the tube 15 is mateably engaged over the outer end 19 of the spade 12.

Figure 2:
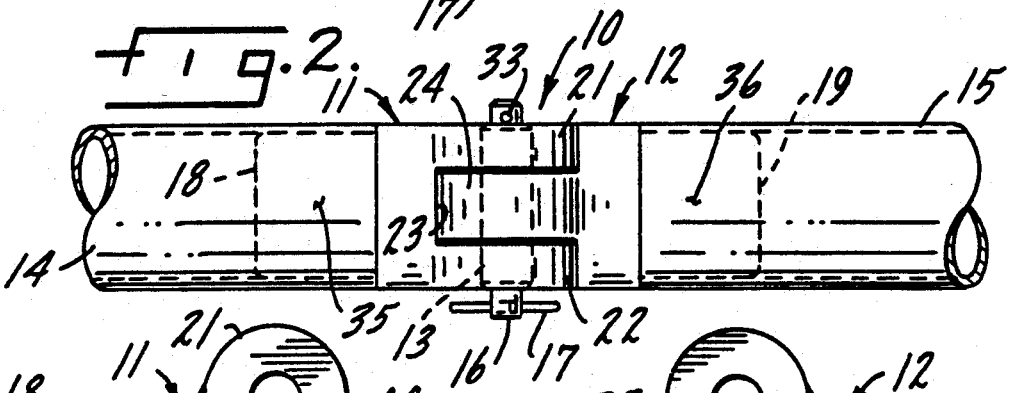
FIG. 2 is a top plan view of the tube hinge shown in FIG. 1.
Figure 7:
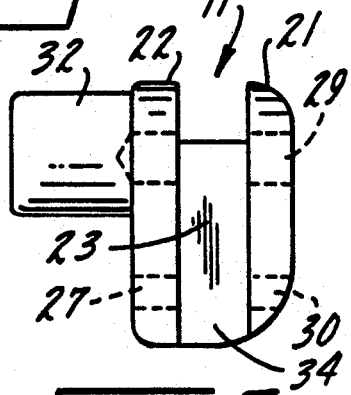
FIG. 7 is a right side view of the clevis portion shown in FIG. 6.

For purposes of nomenclature, the U-shaped member (or yoke) or clevis 11 which can be best seen in FIGS. 2 and 7 will be referred to as the clevis 11. While the term clevis has also been applied to the overall hinge 10, the term hinge will be reserved to mean the pivotal hinge 10 as provided by the clevis 11, the spade 12 and the pivot pin 13. Furthermore, the spade 12 has been also referred to in the prior art as the rod end but the spade 12 will be consistently referred to as the spade 12 below. The pivot pin 13 has been also referred to as a clevis pin in the past but will only be referred to as the pivot pin 13. It will also be noted that the tubes 14, 15 may also be solid rods or other extension members in which event the projecting end portions 18, 19 of clevis 11 and spade 12 respectively would be tubular with an internal diameter sized to receive the solid rods 14, 15. Finally, while the preferred embodiment shown in the figures discloses a fully closed position of about 180°, closed positions of more or less than 180° are available using the present invention.

Also shown in FIG. 1 is the optional locking pin 16 which will lock the tubes 14 and 15 in the 180° or the closed position. The ring 17 provides easy access to the locking pin by the user.

Figure 3:
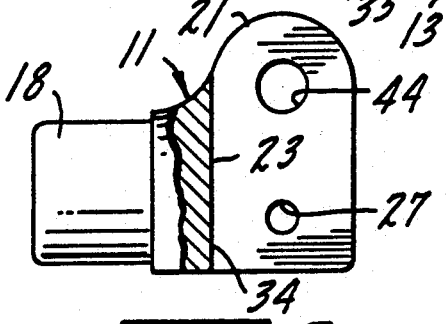
FIG. 3 is a front view of the clevis portion of the tube hinge shown in FIG. 1.

The engagement between the clevis 11 and the spade 12 is best seen in FIG. 2. The clevis 11 includes two parallel ear portions 21, 22 and a rear wall 23 disposed therebetween. The spacing between the ear portions 21, 22 derived from the rear wall 23 provides a slot for accommodating the ear portion 24 of the spade 12. The upper ends of each ear portion 21, 22 and 24 include holes 44 see FIG. 3), 25 (see FIG. 4) and 29 (see FIG. 7) for accommodating the pivot pin 13. Additional holes 27 (see FIG. 3), 28 (see FIG. 4) and 30 (see FIG. 7) for accommodating the locking pin 16 are also provided in the lower ends of the ear portions 21, 22 and 24. The holes 29 and 30 provided in the ear portion 21 are not clearly shown in FIGS. 2 through 4 but can be seen in the alternative embodiment shown in FIG. 7.

In the preferred embodiment of the offset tube hinge 10, the pivot axis defined by the axial center of the pivot pin 13 is offset upwardly from the upper portions 35, 36 of the tubes 14, 15. Because the pivot axis defined by the pivot pin 13 is offset from the upper portions 35, 36 of the outer peripheries of the tubes 14, 15, the hinge 10 may open to a position where the tubes 14, 15 overlie each other without damaging the canvas cover of the convertible top or awning.

Figure 4:
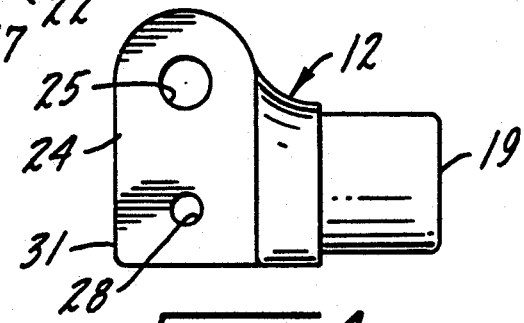
FIG. 4 is a front view of the spade portion of the tube hinge shown in FIG. 1.

The stop means or the means from preventing the hinge 10 from assuming an angle greater than 180° or a negative angle is best understood after consideration of FIGS. 2, 4 and 7. Referring first to FIG. 4, the spade 12 includes an ear portion 24. The hinge pivots about an axis defined by the pivot pin 13 (not shown in FIG. 4) which is accommodated in the hole 25. As the hinge 10 pivots from the closed position shown in FIG. 1 to an angle of less than 180°, the lower end 31 of the ear portion 24 moves arcuately away from the lower end 34 the wall 23 of the clevis 11 (see FIGS. 2, 3 and 7). In contrast, when the hinge 10 is moved from an angle of less than 180° to the fully closed position shown in FIG. 1, the hinge is stopped or prevented from going beyond the fully closed position because the lower end 31 of the ear portion 24 of the spade 12 abuts against the lower end 34 of the wall 23 of the clevis 11. Thus, the tube hinge 10 provided by the present invention includes a built-in stop mechanism that is an integral part of the hinge. It will also be seen that the ear portions 21, 22 and 24 are all in matching registry when the tube hinge 10 is in the fully closed position (see FIG. 1).

As noted above, closed positions other than 180° are available by altering the orientation of the wall 23 and the ear portion 24 of the spade 12. For example, fully closed positions of less than or greater than 180° can be provided by slanting the wall 23 downwardly to the right, or downwardly to the left, respectively.

Figure 5:
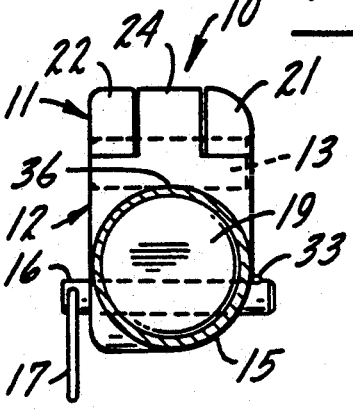
FIG. 5 is a right side view of the tube hinge shown in FIG. 1.

FIG. 5 is a right side view of an open tube hinge 10 and an associated tube 15. The ear portions 21, 22 and 24 are in matching registry. The hinge pivots about the pivot pin 13. The locking pin 16 enables the tube hinge 10 to be locked in the closed position. In the preferred embodiment, the locking pin 16 includes a ball detent 33 which prevents the locking pin 16 from prematurely sliding rearward out of the holes 27, 28 and 30.

Figure 6:
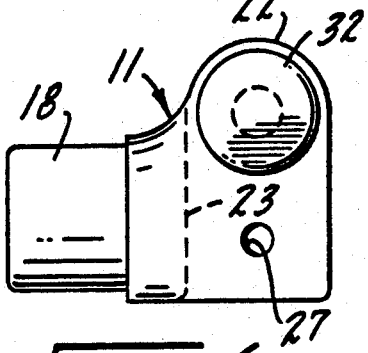
FIG. 6 is a clevis portion of a tube hinge made in accordance with the present invention further illustrating the employment of an optional boss attachment.

Some applications of the tube hinge 10 require it to be mounted on the end of a perpendicularly extending rod or tube. For these applications, FIGS. 6 and 7 illustrate a side boss 32 that is mounted on an ear portion such as 22 of the clevis 11. A tube or rod may be mounted on the side boss 32 in the same fashion that the tubes 14 or 15 are mounted on the outer ends 18 and 19 of the clevis 11 and spade 12 respectively. FIG. 7 is a side view of the clevis 11 shown in FIG. 6 further illustrating the boss 32 extending outwardly from the ear portion 22 of the clevis 11. The side boss 32 will either rotate or remain stationary depending upon whether the clevis 11 rotates or remains stationary.

Also to be noted in FIG. 7 is the wall 23 disposed between the ear portions 21 and 22 of the clevis 11. The lower end 31 of the ear portion 24 of the spade 12 engages the lower end 34 of the wall 23 of the clevis to prevent the tube hinge 10 from extending beyond the 180° or closed position.

The tubes 14, 15 may be attached to the clevis 11 and the spade 12 respectively by conventional press-fit methods, sonic welding, set screw fasteners or other attachment methods. Similarly, if solid rods 14, 15 are employed that insert inside hollow ends 18, 19, the same attachment methods may be used.

Thus, a high strength hinge for tubing is provided that allows two coupled tubes to assume an unlimited range of positions from 0° to 180° in a single plane. The tube hinge 10 includes a built-in stop mechanism that prevents overextension or negative angles beyond the fully closed position shown in FIG. 1. Further, the tube hinge 10 includes an offset pivot axis defined by the pivot pin 13. The offset pivot axis allows the tubes 14 and 15 to be folded over each other in the fully open or folded back position without damaging the covering material.

The present invention is appropriate for use in convertible tops in both the automotive and marine industries as well as for awnings and other applications where it is desirable to have two coupled tubes or rods flex or pivot in a single plane. The clevis 11 and the spade 12 of the present design are preferably each cast as single pieces for high strength. The positive manual locking ring 16 provides strength and rigidity in the closed position. The tube hinge 10 is easily constructed and requires very low assembly time for tube installation.

Although only two specific embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by the specific wording of the foregoing description.

I claim:

1. A hinge comprising:

a clevis, a spade, a pivot pin, the clevis having an inner end and an outer end, the inner end being U-shaped for accommodating the spade, the U-shaped inner end including two parallel ear portions and a wall disposed between the two parallel ear portions, each ear portion including an upper end and a lower end, the wall having an upper end and a lower end, the spade having an inner end and an outer end, the inner end of the spade engaging the U-shaped inner end of the clevis, the inner end of the spade including an ear portion, the ear portion of the spade being at least partially disposed between the parallel ear portions of the clevis whereby the ear portions are in an at least partially overlapping relationship, the ear portion of the spade including an upper end and a lower end, the lower end of the ear portion of the spade being in abutting engagement with the lower end of the wall of the clevis when the hinge is in an open position, the overlapped areas of the upper ends of each ear portion including a hole for accommodating the pivot pin, the pivot pin providing a pivot axis about which the hinge pivots from an open to a closed position.

the outer end of the clevis and the outer end of the spade each being attached to an extension member, whereby the hinge is pivotable about an axis defined by the pivot pin, the hinge pivoting from the open position of about a 0° angle where the extension members attached to the clevis and the spade portions overlie each other to the closed position where the lower end of the ear portion of the spade is in abutting engagement with the lower end of the wall of the clevis.

2. the hinge of claim 1, wherein each extension member includes an outer periphery, each outer periphery including an upper portion, upper portions of both outer peripheries of both extension member being disposed below the pivot axis when the hinge is in the closed position whereby the pivot axis is offset from the upper portions of each extension member.

3. The hinge of claim 1, wherein the hinge is in the closed position when the extension members are at an angle of 180°.

4. The hinge of claim 1, wherein the extension members are tubes and the outer end of the clevis and the outer end of the spade both mateably engage an end of a tube.

5. The hinge of claim 1, wherein each lower end of each ear portion includes a hole, the holes of the lower ends of the ear portions being in matching registry when the hinge is in the closed position.

6. The hinge of claim 5, further comprising a locking pin accommodated in the holes of the lower ends when the hinge is in the closed position for locking the hinge in the closed position.

7. The hinge of claim 1, wherein the clevis further comprises a boss, the boss extending perpendicularly outward from an outer side of one ear portion of the clevis.

8. The hinge of claim 7, wherein the boss mateably engages a tube.

9. The hinge of claim 8, wherein the boss mateably engages an inside of an end of a tube.

10. A hinge comprising:

clevis means, rod end means, pivot means, stop means, extension member means, the clevis means pivotally mateably engaging the rod end means, the clevis means and the rod end means pivoting about the pivot means from an open position to a closed position, the stop means preventing the clevis means and the rod end means from pivoting about the pivot means past the closed position, the clevis means and the rod end means each including outer ends, each outer end including an outer periphery, each outer periphery including an upper portion, each upper portion of each outer periphery of each outer end being disposed below the pivot means when the hinge is in the closed position.

11. The hinge of claim 10, wherein the closed position is an angle of about 180°,

12. The hinge of claim 10, wherein the open position is an angle of about 0°.

13. The hinge of claim 10, wherein the outer ends of both the clevis means and the rod end means both include means for attachment to tube means.

14. The hinge of claim 10, wherein the clevis means and rod end means both include locking means for fixedly locking the hinge in the closed position.

15. The hinge of claim 10, wherein the clevis means further comprises a boss means, the boss means extending perpendicularly outward from the clevis means.

16. The hinge of claim 15, wherein the boss means including means for attachment to a tube means.

* * * * *